US007307042B2

(12) United States Patent
Sakurai et al.

(10) Patent No.: US 7,307,042 B2
(45) Date of Patent: Dec. 11, 2007

(54) THERMAL RECORDING MATERIAL

(75) Inventors: Shinjirou Sakurai, Sodegaura (JP); Keiichi Taki, Sodegaura (JP)

(73) Assignee: Mitsui Chemicals, Inc., Tokyo (JP)

( * ) Notice: Subject to any disclaimer, the term of this patent is extended or adjusted under 35 U.S.C. 154(b) by 95 days.

(21) Appl. No.: 10/524,559

(22) PCT Filed: Aug. 6, 2003

(86) PCT No.: PCT/JP03/10005

§ 371 (c)(1),
(2), (4) Date: Feb. 14, 2005

(87) PCT Pub. No.: WO2004/016440

PCT Pub. Date: Feb. 26, 2004

(65) Prior Publication Data

US 2006/0166821 A1 Jul. 27, 2006

(30) Foreign Application Priority Data

Aug. 14, 2002 (JP) ..... 2002-236471

(51) Int. Cl.
*B41M 5/40* (2006.01)

(52) U.S. Cl. ..... 503/226; 503/200

(58) Field of Classification Search ..... 503/200–226
See application file for complete search history.

(56) References Cited

U.S. PATENT DOCUMENTS

| | | | |
|---|---|---|---|
| 4,948,775 | A | 8/1990 | Tsuji et al. |
| 5,409,881 | A | 4/1995 | Mori et al. |
| 2001/0044553 | A1 | 11/2001 | Kabashima et al. |

FOREIGN PATENT DOCUMENTS

| | | | |
|---|---|---|---|
| EP | 0 436 390 | A2 | 7/1991 |
| JP | 43-4160 | | 2/1968 |
| JP | 45-14039 | | 5/1970 |
| JP | 49-036343 | | 4/1974 |
| JP | 57-019036 | A | 2/1982 |
| JP | 57-188392 | A | 11/1982 |
| JP | 60-068990 | A | 4/1985 |
| JP | 61-037467 | A | 2/1986 |
| JP | 64-061287 | A | 3/1989 |
| JP | 01-133783 | | 5/1989 |
| JP | 04-191088 | | 7/1992 |
| JP | 04-191088 | A | 7/1992 |
| JP | 05-318926 | A | 12/1993 |
| JP | 10-175376 | | 6/1998 |
| JP | 10-175376 | A | 6/1998 |
| JP | 11-314454 | A | 11/1999 |
| JP | 2002-052841 | | 2/2002 |
| JP | 2002-307825 | A | 10/2002 |
| JP | 2002-307831 | A | 10/2002 |
| JP | 2003-182216 | A | 7/2003 |

*Primary Examiner*—Bruce H. Hess
(74) *Attorney, Agent, or Firm*—Buchanan Ingersoll & Rooney PC

(57) ABSTRACT

The present invention provides a thermal recording material, which is easy to manufacture and has excellent productivity, water resistance, heat resistance (running stability) and chemical resistance, by solving various problems caused by using a crosslinking agent for a protective layer.

The thermal recording material of the present invention comprises a protective layer mainly composed of a resin emulsion (a) comprising a copolymer resin emulsion (b) containing (meth)acrylonitrile and a vinyl monomer copolymerizable therewith, and having an SP value (solubility parameter) of 12.0 or more, a glass transition temperature (Tg) of 10 to 70° C., and a minimum film-forming temperature (MFT) of 5° C. or less, and a polyolefin copolymer resin emulsion (c).

4 Claims, No Drawings

THERMAL RECORDING MATERIAL

BACKGROUND OF THE INVENTION

1. Field of the Invention

The present invention relates to a thermal recording material, and more specifically to a thermal recording material which, by using a protecting layer made from a coating solution not having a crosslinking agent combined therewith, can contribute greatly to improvement in productivity, and solves various problems caused by the crosslinking agent, and at the same time, has improved heat resistance, water resistance and chemical resistance.

2. Description of the Related Art

Generally, a recording material which comprises a recording layer formed on a support and mainly composed of an electron donating colorless or lightly colored basic dye and an electron accepting organic or inorganic substance and having a binder, a filler, a sensitizer, a lubricant and the like blended therewith, are well known as a thermal recording material by a color reaction through a fusion contact between functional units by heat. (Japanese Examined Patent Publication Nos. 43-4160, 45-14039 and the like).

Such a thermal recording material is widely used for an output sheet for a variety of printers including facsimiles, a terminal for industrial instrumentation, a terminal for medical care, a handy terminal, a POS system and a ticket vending system because recording function is beforehand effected with the support (a paper, a synthetic paper, a synthetic resin film and the like). Thus, an image can be obtained by simply heating it with a thermal head, a thermal pen, a laser beam and the like, a complicated development process is not required, and an output device having a relatively simple and compact structure, and easy maintenance can be used.

In recent years, as the application of these thermal recording materials is expanding, the environments in which they are used have are also diversifying. However, there are the following prevalent problems in their ordinary use.

Specifically, the recording layer often peels off when the thermal recording materials are brought into contact with water, the recorded images fade or discolor when the thermal recording materials are brought into contact with a plastic film or sheet comprising plasticizers, the recorded images develop color when the thermal recording materials are brought into contact with organic solvents, and the like, and thus the thermal recording materials do not sufficiently satisfy storage stability.

Therefore, as means for solving the above-mentioned problems, various methods in which a protective layer is provided on a heat-sensitive recording layer have been proposed and carried out. However, these methods require that the protective layer be crosslinked in order to highly protect the heat-sensitive recording layer under various environments. For this purpose, the protective layer is prepared by curing it with combinations of various aqueous resins and various crosslinking agents, and the like. For example, the protective layer having improved oil resistance and heat resistance (adhesion of gases to a thermal head) by using glycidyl type crosslinking agents (Japanese Unexamined Patent Application Publication No. 57-188392) has been proposed, but it has poor reactivity and water resistance.

A protective layer having an amino compound together with a glycidyl-based crosslinking agent (Japanese Unexamined Patent Application Publication No. 64-61287) has excellent water resistance and chemical resistance, but it is not suitable for labels for foods because it generates formalin. Although an aziridine-based crosslinking agent has a high reaction rate, it is unstable in an aqueous solution, which makes it difficult to handle. A method using an isocyanate-based compound (Japanese Unexamined Patent Application Publication No. 57-19036) is similarly not satisfactory. Proposals of using an epoxy-based crosslinking agent (Japanese Unexamined Patent Application Publication Nos. 49-36343, 60-68990, and 5-318926) still have problems in that a crosslinking agent having an aromatic ring is insufficient in providing resistance to plasticizers and that a crosslinking agent based on glycidyl ether of polyhydric alcohol causes a skin color development. A known polyamine-amide-epichlorohydrin modified crosslinking agent is not preferred in view of environmental conservation because it contains chlorine.

As such, the methods using crosslinking agents make it possible to solve the above-mentioned problems to some extent, but the methods are still insufficient in overcoming the problems.

Further, since these crosslinking agents are crosslinked at low temperatures, it is difficult to ensure the stability of a coating solution (variation over time) after mixing it with a resin as a main ingredient, and heat required for the crosslinking agents for sufficient crosslinking of the thermal recording material, cannot be applied thereto during the production process, in view of the properties of the thermal recording materials. For these reasons, there are problems in the process wherein after coating, the thermal recording materials must be aged over a long time period, which cause problems in its productivity.

In view of the circumstances explained above, an object of the present invention is to provide a thermal recording material, which is easy to manufacture and has excellent productivity, and also excellent in water resistance, heat resistance (running stability) and chemical resistance, by solving various problems caused by using a crosslinking agent for a protective layer.

SUMMARY OF THE INVENTION

An aqueous resin includes the resin in the form of a water-soluble resin and emulsion. Among these, the aqueous resin emulsion has advantages over the water-soluble resin in that ① it has good water resistance, ② it is easy to handle because of its low viscosity even at high concentrations, ③ it can efficiently exhibit a targeted function by controlling its particle structure, ④ it is not a dangerous substance and thus it is not limited by legal restrictions in its handling, and that ⑤ it has low toxicity.

The present inventors have conducted extensive studies to solve the foregoing problems by making the utmost use of the advantages of the emulsion, and as a result, have found that the above object can be achieved by using a protective layer of a thermal recording material made from the aqueous resin emulsion having specific composition and structure, and have thus completed the present invention on the basis of this finding.

The present invention is characterized by the matters described in the following [1] to [3]:

[1] A thermal recording material comprising a heat-sensitive recording layer formed on a support and color-developed by heat, and a protective layer formed on the heat-sensitive recording layer and mainly composed of a resin emulsion (a), wherein, (1) the resin emulsion (a) comprises a copolymer resin emulsion (b) containing (meth)acrylonitrile and a vinyl monomer copolymerizable therewith, and having an SP value (solubility parameter) of 12.0 or more, a glass transition temperature (Tg) of 10 to 70° C., and a minimum film-forming temperature (MFT) of 5° C. or less, and a polyolefin copolymer resin emulsion (c), (2) 1 to 10 parts by weight of vinyl monomers having a carboxyl group is comprised in 100 parts by weight of the solid content of the copolymer resin emulsion (b), and (3) the protective layer does not contain a crosslinking agent;

[2] the thermal recording material as described in the above [1], wherein a solid content weight ratio of the copolymer resin emulsion (b) /the polyolefin copolymer resin emulsion (c) in the resin emulsion (a) is in a range from 100/10 to 100/0.5; and

[3] the thermal recording material as described in the above [1] or [2], wherein the polyolefin copolymer resin emulsion (c) is at least one selected from the group consisting of a homopolymer of an α-olefin having 2 to 16 carbon atoms and a copolymer of two or more of the α-olefins.

DESCRIPTION OF THE PREFERRED EMBODIMENTS

Hereinafter, a thermal recording material according to the present invention is described in detail.

The resin emulsion (a) of the present invention comprises two resin emulsions for the propose of exhibiting basic properties required for a protective layer of a thermal recording material, that is, storage stability (water resistance, resistance to plasticizers, resistance to solvents and the like) and running stability (heat resistance) without using a crosslinking agent. That is, the resin emulsion is provided as a uniform mixture of a copolymer resin emulsion (b) composed of (meth)acrylonitrile and a vinyl monomer copolymerizable therewith and having a solubility parameter (SP value) of 12.0 or more, and a polyolefin copolymer resin emulsion (c). Among these, the copolymer resin emulsion (b) requires an increased internal cohesive force of the resin and an SP value of 12.0 or more for strongly protecting a heat-sensitive layer from an external environment (resistance to plasticizers, resistance to solvents, resistance to chemicals and the like) as a protective layer and for heat resistance against heat received from a thermal head at the time of using it (stickiness). If the SP value is less than 12, the cohesive force between resin molecules is insufficient, whereby the plasticizers and the solvents penetrate the protective layer (between the resin molecules) and then the heat-sensitive layer, and as a result, it causes problems in storage stability, including unnecessary color development and fading, and at the same time temperature sensitivity increases and hence the protective layer is easily softened by heat and running stability of the thermal head becomes insufficient. The upper limit of the SP value is not particularly restricted, but in view of its limit in materials used industrially and properties of the resin which is applied to the present invention, it is in a range of 14 or less. If it exceeds 14, the hydrophilic property of the resin increases, and thus one of the basic properties which are required for the protective layer, water resistance thereof is greatly lowered, and it also becomes difficult to manufacture the resin emulsion (b) itself. In addition, the SP value of the present invention utilizes a value derived from the molecular structure of each copolymerizing component and the sum of the evaporation energy of an atomic group, and the molar volume ratio of the copolymerizing components.

The proportion of (meth)acrylonitrile used is not particularly restricted, but it preferably ranges from 20 to 80 parts by weight and more preferably 30 to 70 parts by weight in 100 parts by weight of the solid content of the copolymer resin emulsion (b). When the amount of (meth)acrylonitrile used is too small, water resistance as required is not obtained, there causes a problem in running stability, and sufficient resistance to plasticizers may not be obtained. When the amount of (meth)acrylonitrile used is too large, there be caused problems in film-forming ability, binding capacity to a filler or the like because the production (polymerization) stability of the emulsion itself may be insufficient and Tg becomes higher than is necessary. Therefore, it is necessary to set a glass transition temperature (Tg) such that it does not damage the effects of the present invention by copolymerizing with other vinyl monomers copolymerizable in the above-mentioned range.

Examples of (meth)acrylonitrile and a vinyl monomer copolymerizable therewith include (meth)acrylates such as methyl(meth)acrylate, ethyl(meth)acrylate, butyl(meth) acrylate, 2-ethylhexyl(meth)acrylate, lauryl(meth)acrylate, 2-hydroxyethyl(meth)acrylate, 2-hydroxypropyl(meth)acrylate, 2-hydroxybutyl(meth)acrylate, 2-aminoethyl(meth) acrylate, 2-(N-methylamino)ethyl(meth)acrylate, 2-(N,N-dimethylamino)ethyl(meth)acrylate and glycidyl(meth) acrylate; vinyl esters such as vinyl acetate and vinyl propionate; aromatic vinyl monomers such as styrene, a-methylstyrene and divinylbenzene; N-substituted unsaturated carboxylic acid amides such as (meth)acrylamide and N-methylol(meth)acrylamide; heterocyclic vinyl compounds such as vinylpyrrolidone; halogenated vinylidene compounds such as vinylidene chloride and vinylidene fluoride; α-olefins such as ethylene and propylene; dienes such as butadiene; and the like, in addition to examples of a vinyl monomer to be described later, which may be used alone or in combination of two or more of these.

The polyolefin copolymer resin emulsion (c) of the present invention is dispersed uniformly and independently in the copolymer resin emulsion (b) and thus provides the resin emulsion (a), and has a function for improving remarkably the running stability and heat resistance which are required for the protective layer, because of the synergistic effect thereof with the copolymer resin emulsion (b). On the other hand, the synergistic effect does not exhibit in a range of less than the SP value of the present invention although reasons are not clear.

The particle size thereof is not particularly limited, but it is preferred that the particle size is small, preferably 2000 nm or less, and more preferably 1000 nm or less. When the particle size is large, the polyolefin copolymer resin emulsion is separated as an upper layer in the resin emulsion (a) and the protective layer becomes heterogeneous because it is insufficient in uniform dispersibility or the like, and hence the physical properties of the protective layer may not stably exhibit. When it is 1000 nm or less, the polyolefin copolymer resin emulsion can be independently present stably and uniformly in the system. Further, when these emulsions are used in the proportions, function exhibiting effects thereof are also large.

The vinyl monomer having a carboxyl group in the copolymer resin emulsion (b) of the present invention is not only essential for ensuring the polymerization stability when preparing the copolymer resin emulsion (b), but is also effective for improving film-forming ability for the resin particles are hydrated, swollen and softened by neutralizing it with a base after its polymerization. In addition, the vinyl monomer has also a function for improving dispersibility and bondability in various fillers to be added if necessary.

Further, it serves as a reactive group which reacts with a crosslinking agent to be combined therewith if necessary.

The amount of the vinyl monomer having a carboxyl group preferably ranges from 1 to 10 parts by weight and more preferably 2 to 8 parts by weight in 100 parts by weight of the solid content of the copolymer resin emulsion (b) If it is less than 1 part by weight, the film-forming ability becomes insufficient because polymerization stability is insufficient, and swelling and softening of the resin particles are insufficient even if neutralized. If it exceeds 10 parts by weight, the protective layer is insufficient in water resistance and the resin particles dissolve when controlling the neutralization thereof and thus the gelation thereof may occur.

Examples of the vinyl monomer having a carboxyl group include ethylenically unsaturated monobasic carboxylic acids such as acrylic acid, methacrylic acid and crotonic acid; ethylenically unsaturated dibasic carboxylic acids such as itaconic acid, maleic acid and fumaric acid; and monoalkyl esters thereof, which may be used at least one or in combination of two or more of these.

The weight ratio of the solid contents of the polyolefin copolymer resin emulsion (c) in the present invention ranges from 0.5 to 10 parts by weight, preferably 1 to 10 parts by weight and more preferably 2 to 10 parts by weight per 100 parts by weight of the solid content of the resin emulsion (a). If it exceeds 10 parts by weight, the film-forming ability of the protective layer is impaired and defects in a coating film are liable to occur, and further it may cause problems in ink adhesion when printing onto the coating film. If it is less than 0.5 parts by weight, function improving effect in running stability and heat-resistant stability cannot exhibit.

Examples of the polyolefin copolymer resin emulsion include a homopolymer of an α-olefin and/or a copolymer of two or more of the α-olefins, wherein α-olefin includes ethylene, propylene, 1-butene, 3-methyl-1-butene, 4-methyl-1-pentene, 3-methyl-1-pentene, 1-heptene, 1-hexene, 1-octene, 1-decene and 1-dodecene. Among these, ethylene, propylene and 1-butene are preferably used.

Although the average particle size (number average) of the copolymer resin emulsion (b) in the present invention is not particularly limited, it is preferably 50 to 500 nm, more preferably 70 to 300 nm. If the average particle size is too small, the viscosity of the emulsion becomes remarkably high. In this case, because the concentration of the resin must be low during the production of the emulsion, the coating solution of the protective layer is also low in the drying property, thereby causing problems in productivity of the thermal recording material of the present invention, and thus it being not preferable in economy. On the other hand, if the average particle size is too large, the heat-sensitive recording layer is often insufficient in storage stability because it is difficult to form a close protective layer. The particle size can be controlled by the composition of the copolymer resin emulsion (b) and a surfactant and thus is adjusted within the above-mentioned range.

In addition, the glass transition temperature (Tg) of the copolymer resin emulsion (b) preferably ranges from 10 to 70° C., more preferably 20 to 60° C. If the glass transition temperature is less than 10° C., heat resistance is deteriorated, while if it exceeds 70° C., there may be caused problems in that film-forming ability is deteriorated.

Further, in the present invention, a minimum film-forming temperature (MFT) of the copolymer resin emulsion (b) is 5° C. or less.

When the copolymer resin emulsion (b) is produced, an emulsifying agent can be used to give stability, if necessary. For example, anionic surfactants such as sulfates of higher alcohols, alkylbenzenesulfonates, aliphatic sulfonates and alkyldiphenyl ether sulfonates; nonionic surfactants such as an alkyl ester-type nonionic surfactant, an alkyl phenyl ether-type nonionic surfactant and an alkyl ether-type nonionic surfactant of a polyethylene glycol, can be used alone or in combination of two or more of these. The amount of these emulsifying agents is not particularly limited, but they are preferably used in the lowest required amount in view of water resistance of resins.

Examples of a polymerization initiator used in the production of the copolymer resin emulsion (b) include water-soluble initiators such as persulfates, hydrogen peroxide, organic hydroperoxide and azobiscyanovaleric acid; oil-soluble initiators such as azobisisobutyronitrile and benzoyl peroxide; or redox initiators combined with a reducing agent. The amount of the polymerization initiators is not particularly limited and may be selected according to conventional techniques. However, it usually ranges from 0.1 to 10 parts by weight and preferably 0.1 to 5 parts by weight per 100 parts by weight of the vinyl monomer.

In addition, in the production of the copolymer resin emulsion (b), a molecular weight modifier (a chain transfer agent) may be used, if necessary, and examples thereof include mercaptans such as octylmercaptan, n-dodecylmercaptan and t-dodecylmercaptan; and low molecular weight halogen compounds.

The copolymer resin emulsion (b) is neutralized by a base, and (aqueous) ammonia is used as the neutralizer in this case. Examples of the neutralizer include sodium hydroxide, potassium hydroxide and various amines, in addition to (aqueous) ammonia, but these may cause desensitization in water resistance of the protective layer, damage to the thermal head or color development by heat. If (aqueous) ammonia is used, water resistance after formation of the protective layer can exhibit in a short time because there are no adverse effects described above and it is easy to remove it at a relatively low temperature.

In the present invention, the filler can also be blended in the protective layer, if necessary. The amount added is not particularly limited, but the kind and the amount of the filler can be appropriately selected within the range that does not adversely affect the present invention. Examples of the filler include inorganic fillers such as calcium carbonate, magnesium carbonate, kaolin, talc, clay, aluminum hydroxide, barium sulfate, silicon oxide, titanium oxide, zinc oxide and colloidal silica; and organic fine particles such as urea-formalin resins and polystyrene fine particles, which may be used alone or in combination of two or more of these.

Examples of the components used, if necessary, in addition to the filler, include lubricants such as metal salts of higher fatty acids and higher fatty acid amides for improving the running stability; ultraviolet absorbers; antioxidants; antifoaming agents; wetting agents; viscosity adjusting agents; other auxiliary agents and additives.

In particular, although the addition of a crosslinking agent is not required in the present invention, the amount thereof used may be appropriately adjusted depending on the circumstances without any trouble and is not limited, provided that the amount thereof used does not adversely affect the effects of the present invention. In such a case, the crosslinking agent must be suitably selected from the materials capable of reacting with a carboxyl group contained in the copolymer resin emulsion (b) and various functional groups (a hydroxyl group, a methylol group, an amino group, an acetoacetyl group, a glycidyl group, etc.) other than a carboxyl group, introduced from a vinyl monomer copolymerizable. Examples of the materials include glyoxal, dimethylolurea, glycidyl ether of polyhydric alcohol, ketene dimer, dialdehyde starch, a polyamine-amide-epichlorohydrin modified product, ammonium zirconium carbonate, aluminum sulfate, calcium chloride, and boric acid.

As for resin components constituting the protective layer of the present invention, if necessary, other known aqueous resins can be also used, in addition to the resin emulsion (a) of the present invention. Examples of the resin include a natural resin (for example, sodium alginate, starch, casein, celluloses) and a synthetic resin (polyvinyl alcohol, various synthetic rubber latex, polyurethane, epoxy, vinyl chloride, vinylidene chloride, etc.). Of these, modified products of polyvinyl alcohol are preferred and examples thereof include carboxyl-modified polyvinyl alcohol, epoxy-modified polyvinyl alcohol, silanol-modified polyvinyl alcohol, acetoacetyl-modified polyvinyl alcohol, amino-modified polyvinyl alcohol, olefin-modified polyvinyl alcohol, amide-modified polyvinyl alcohol, and nitrile-modified polyvinyl alcohol, but it is not limited to these.

A region on which the resin emulsion (a) of the present invention is applied, is not limited to the surface side of the heat-sensitive recording layer and the back side of the support, and the emulsion can be appropriately applied onto a part in which requires a function as a protective layer.

In addition, a coloring system of the heat-sensitive recording layer according to the present invention is also not particularly limited. Examples of the coloring system include a system comprising an acidic substance representative of a leuco dye and a phenolic substance, a system comprising an imino compound and an isocyanate compound, and a system comprising a diazo compound and a coupler.

The protective layer of the present invention is applied on a known heat-sensitive recording layer provided normally on a paper, a synthetic paper, a film, etc. as a support and/or on the back side of the support, and between the support and the heat-sensitive recording layer, in a range of 1 to 10 g/m$^2$ in terms of dry weight, using an air-knife coater, a gravure coater, a rod coater and the like, thereby achieving the object of the present invention. However, in the case where the protective layer needs high glossiness at the surface thereof if necessary, it can deal with the case by removing the filler from the components constituting the protective layer.

EXAMPLES

The present invention will be further described in detail with reference to Examples, but the present invention is not limited to these Examples. The terms "parts" and "%" in these Examples indicate "parts by weight" and "% by weight", respectively unless otherwise specified.

Preparation of a copolymer resin emulsion(b)

Preparation Example (b)1

Into a separable flask equipped with a stirrer and a reflux condenser were put 195 parts of deionized water and 0.3 part of sodium dodecylbenzenesulfonate, the air in the flask was replaced with nitrogen gas and then the temperature of the flask was raised to 70° C. After raising the temperature, 1.0 part of potassium persulfate was put into the flask. Then, an emulsion of vinyl monomers having the following composition was continuously put into the-flask over about 4 hours, the temperature was raised to 80° C. and was maintained as it is for 2 hours to complete the polymerization. After completing the polymerization, subsequently the emulsion of copolymer were neutralized by adding aqueous ammonia, were further maintained at the same temperature for 1 hour, hydrated, swollen and softened, and then cooled to room temperature and adjusted to pH 8.0 to give a copolymer resin emulsion (b)l having a solid content of about 30%.

| (Composition of the Vinyl Monomers Emulsion) | |
|---|---|
| acrylonitrile | 30.0 parts |
| n-butyl acrylate | 50.0 parts |
| methacrylic acid | 10.0 parts |
| 2-hydroxyethyl methacrylate | 10.0 parts |
| n-dodecylmercaptan | 0.5 part |
| deionized water | 40.0 parts |
| sodium dodecylbenzenesulfonate | 0.5 part |

Preparation Examples (b)2 to (b)5 and Comparative Preparation Examples (b)6 to (b)8

Except that the composition of the vinyl monomers was changed, the same procedures used in Preparation Example (b)1 were repeated to prepare copolymer resin emulsion(b)2 to (b)5, and Comparative Preparation Examples (b) 6 to (b) 8. The composition and the results are summarized in Table 1.

In the Table, the evaluation criteria of a solubility parameter (SP value), a glass transition temperature and production stability are as follows:

(Solubility Parameter)

The solubility parameter of the emulsion was evaluated according to a method described in "Journal of Coatings Technology (Vol. 5, No. 696, pp. 100 (1983)".

(Glass Transition Temperature)

The glass transition temperature was the glass transition temperature of a copolymer, and calculated according to Fox formula described in "Bulletin of the American Physical Society, Vol. 1, No. 3, pp. 123 (1956)".

(Production Stability)

○: The emulsion has stable emulsion particles having an opal appearance, and there is no generation of aggregates, deposits onto a mixing impeller, and a residual during the production of the emulsion.

Δ: Some aggregates are adhered to the mixing impeller during the production of the emulsion.

×: The polymerization of the emulsion does not proceed. That is, the resultant polymer is insufficient in dispersion stabilization and thus the entire aggregates.

Comparative Preparation Example (b)9

A copolymer resin emulsion (b)9 was obtained in the same manner as in Preparation Example (b)2 except that the swelling treatment was not conducted.

Comparative Preparation Example (b)10

A copolymer resin emulsion (b) 10 was obtained according to Preparation Example described in Japanese Patent No. 2953630.

Next, Examples will be described in detail below, in which the foregoing copolymer resin emulsions obtained in Preparation Examples (b) 1 to (b) 5 and Comparative Preparation Examples (b) 6 to (b)10 were used in the preparing protective layers to give corresponding thermal recording materials. In all the following Examples, the composition is expressed in "parts by weight". Further, in the Comparative Preparation Examples, the copolymer resin emulsion(b)8 obtained in Comparative Preparation Example (b)8, which had problems in production stability, was not used in the following Examples.

Example 1

To 100 g of the copolymer resin emulsion (b)1 obtained in Preparation Example (b) 1 was added 7.1 g of a polyolefin copolymer resin emulsion (available from Mitsui Chemicals, Inc.: particle size 400 nm, Chemipearl W4005) having a solid content of 42%, and the reaction mixture was sufficiently stirred to prepare a resin emulsion (a)1. Then, to the prepared resin emulsion were added 3.0 g of an aqueous zinc stearate dispersion (available from Chukyo Yushi. Co., Ltd.: F115 fine particle type) having a solid content of 20% and 50 g of water, and the mixture was uniformly mixed and then was applied onto the surface of a commercially available heat-sensitive paper for word processor having no surface treatment so as to be 3 g/m$^2$ in terms of dry weight using a bar coater and dried (after forced drying at 6.0° C. for 30 seconds, curing under 20° C./60% RH atmosphere for 24 hours) to give a thermal recording material.

Example 2

A thermal recording material was obtained in the same manner as in Example 1 except that the copolymer resin emulsion (b)2 obtained in Preparation Example was used and 3.6 g of the polyolefin copolymer resin emulsion was added (for preparation of the resin emulsion (a) 2), and 25 g of an 60% aqueous dispersion of kaolinite clay (available from Engelhard Corporation: UW90) as a filler was added to the resultant emulsion.

Example 3

A thermal recording material was obtained in the same manner as in Example 1 except that the copolymer resin emulsion (b)3 obtained in Preparation Example was used and 2.9 g of the polyolefin copolymer resin emulsion was added (for preparation of a resin emulsion (a)3), and 12 g of an 50% aqueous dispersion of fine particle silica (available from Mizusawa Industrial Chemicals, Ltd.: P-527) as a filler was added to the resultant emulsion.

Example 4

A thermal recording material was obtained in the same manner as in Example 1 except that the copolymer resin emulsion (b)4 obtained in Preparation Example was used and 1.4 g of the polyolefin copolymer resin emulsion was added (for preparation of a resin emulsion (a)4).

Example 5

A thermal recording material was obtained in the same manner as in Example 1 except that the copolymer resin emulsion (b)5 obtained in Preparation Example was used and 2.1 g of the polyolefin copolymer resin emulsion was added (for preparation of a resin emulsion (a) 5), and 24 g of an 50% aqueous dispersion of heavy calcium carbonate (available from Shiraishi Calcium Kaisha, Ltd.: Softon 1800) as a filler was added to the resultant emulsion.

Comparative Example 1

A thermal recording material was obtained in the same manner as in Example 3 except that the copolymer resin emulsion (b)6 obtained in Comparative Preparation Example was used (for preparation of a resin emulsion (a)6).

Comparative Example 2

A thermal recording material was obtained in the same manner as in Example 4 except that the copolymer resin emulsion (b)7 obtained in Comparative Preparation Example was used (for preparation of a resin emulsion (a)7).

Comparative Example 3

A thermal recording material was obtained in the same manner as in Example 2 except that 10.7 g of the polyolefin copolymer resin emulsion was added (for preparation of a resin emulsion (a)8).

Comparative Example 4

A thermal recording material was obtained in the same manner as in Example 3 except that the polyolefin copolymer resin emulsion was not added.

Comparative Example 5

A thermal recording material was obtained in the same manner as in Example 1 except that a copolymer resin emulsion (b)9 was substituted for the copolymer resin emulsion (b)1.

Comparative Example 6

A thermal recording material was obtained by using a copolymer resin emulsion (b) 10 according to Japanese Patent No. 2953630.

The compositions of the resin emulsions (a)1 to (a)9 used in Examples and Comparative Examples are shown in Table 2.

The thermal recording materials obtained in Examples 1 to 5 and Comparative Examples 1 to 6 as described above were evaluated according to the following methods, and the results obtained are shown in Tables 3 and 4.

(1) Running Stability

Solid black recording pattern image was formed on the surface of a protective layer under the following conditions using a heat-sensitive printer (available from Ohkura Electric Co. Ltd.: TH-PMD), and then level of noise (crackling sound), head contamination, and the surface state of the protective layer were synthetically evaluated.

Voltage applied: 24 V

Pulse width: 1.74 ms

Energy applied: 0.34 mJ/dot

○: No noise was produced, no head contamination was observed, the surface state of the protective layer was good, and paper could be smoothly supplied.

Δ: Some noises were generated but no head contamination was observed, the surface state of the protective layer was good, and paper could be smoothly supplied.

×: Crackling sound was generated, head contamination was observed, the surface of the protective layer was rough, and paper could not be smoothly supplied.

(2) Water Resistance

The uncolored part, and the heat-sensitive recording surface which had been color-developed by putting a thermal block of 140° C. on it for 1 second, were rubbed with a gauze containing water over 20 times using a Gakushin-type rubbing fastness test machine (without any load) and then the state of the heat-sensitive recording layer was observed.

○: Not changed.

Δ: Scratches were recognized.

×: The heat-sensitive recording layer was peeled off.

(3) Resistance to Plasticizers

A transparent polyvinyl chloride adhesive tape for electric insulation (available from Nitto Denko Corporation) was attached to an imaging portion in which images had formed under the same conditions as stated above. After standing at 40° C. for 24 hours, it was peeled off and then the optical density of the unattached portion and the optical density of the tape-attached portion were measured with a Macbeth densitometer to calculate the d optical density retention (%) according to the following formula (a higher value is better).

optical density retention (%)=(optical density of the tape-attached portion)÷(optical density of the unattached portion)×100

(4) Stability of a Blended Solution in a Protective Layer

After standing at 40° C. for 24 hours, the state of the blended solution in the protective layer was synthetically observed (thickening, gelation, separation).

Further, the thermal recording material obtained in Comparative Example 5 was insufficient in film-forming property and hence it could not be used for evaluation.

TABLE 1

| | Preparation Example | | | | | Comparative Preparation Example | | |
|---|---|---|---|---|---|---|---|---|
| Composition | (b)1 | (b)2 | (b)3 | (b)4 | (b)5 | (b)6 | (b)7 | (b)8 |
| Acrylonitrile | 30 | 55 | 65 | 65 | 65 | 30 | 45 | 62 |
| n-butyl acrylate | 40 | 30 | 30 | 20 | | 27 | 39 | |
| 2-ethylhexyl acrylate | | | | | 23 | 20 | | |
| methacrylic acid | 10 | 7 | 5 | 7 | | 13 | | 3 |
| acrylic acid | | | | | 2 | | 1 | |
| 2-hydroxyethyl acrylate | | | | | 10 | | | 15 |
| 2-hydroxyethyl methacrylate | 20 | 5 | | 5 | | 10 | 15 | |
| acrylamide | | 3 | | 3 | | | | 20 |
| SP value (solubility parameter) | 12.08 | 12.86 | 12.98 | 13.30 | 12.84 | 11.56 | 12.40 | 14.15 |
| Tg° C. (glass transition temperature) | 16.5 | 40.1 | 40.6 | 61.0 | 29.7 | 4.7 | 16.8 | 86.2 |
| production Stability | ○ | ○ | ○ | Δ | ○ | ○ | ○ | aggregation |

TABLE 2

| | (a) | Composition (b)/(c) | Proportion (solid content) |
|---|---|---|---|
| Ex. 1 | (a)1 | (b)1/Chemipearl W4005 | 100/10 |
| Ex. 2 | (a)2 | (b)2/Chemipearl W4005 | 100/5 |
| Ex. 3 | (a)3 | (b)3/Chemipearl W4005 | 100/4 |
| Ex. 4 | (a)4 | (b)4/Chemipearl W4005 | 100/2 |
| Ex. 5 | (a)5 | (b)5/Chemipearl W4005 | 100/3 |
| Com. Ex. 1 | (a)6 | (b)6/Chemipearl W4005 | 100/4 |

TABLE 2-continued

| | (a) | Composition (b)/(c) | Proportion (solid content) |
|---|---|---|---|
| Com. Ex. 2 | (a)7 | (b)7/Chemipearl W4005 | 100/2 |
| Com. Ex. 3 | (a)8 | (b)2/Chemipearl W4005 | 100/15 |
| Com. Ex. 5 | (a)9 | (b)9/Chemipearl W4005 | 100/10 |

(a): Resin emulsion (b): Copolymer resin emulsion (c): Polyolefin copolymer resin emulsion

TABLE 3

| | (a) Resin emulsion | Crosslinking agent |
|---|---|---|
| Ex. 1 | (a)1 | None |
| Ex. 2 | (a)2 | None |
| Ex. 3 | (a)3 | None |
| Ex. 4 | (a)4 | None |
| Ex. 5 | (a)5 | None |
| Com. Ex. 1 | (a)6 | None |
| Com. Ex. 2 | (a)7 | None |
| Com. Ex. 3 | (a)8 | None |
| Com. Ex. 4 | (b)3 alone | None |
| Com. Ex. 5 | (a)9 | None |
| Com. Ex. 6 | (b)10 alone | Uramine P5600 |

TABLE 4

| | Running stability | Color density | Glossiness | Water resistance | Resistance to plasticizers % | Coating stability*1 |
|---|---|---|---|---|---|---|
| Ex. 1 | ○ | 1.87 | 86 | ○ | 90 | Good |
| Ex. 2 | ○ | 1.60 | 65 | ○ | 100 | Good |
| Ex. 3 | ○ | 1.41 | 25 | ○ | 95 | Good |
| Ex. 4 | ○ | 1.85 | 92 | ○ | 100 | Good |
| Ex. 5 | ○ | 1.51 | 30 | ○ | 95 | Good |
| Com. | Δ | 1.42 | 25 | x | ○ | Good |

TABLE 4-continued

| | Running stability | Color density | Glossi-ness | Water resistance | Resistance to plasti-cizers % | Coating stability*[1] |
|---|---|---|---|---|---|---|
| Ex. 1 | | | | | | |
| Com. Ex. 2 | ○ | 1.73 | 87 | x | 20 | Good |
| Com. Ex. 3 | Δ | 1.55 | 45 | ○ | 35 | Good |
| Com. Ex. 4 | x | 1.40 | 30 | ○ | 100 | Good |
| Com. Ex. 5 | — | — | — | — | — | — |
| Com. Ex. 6 | ○ | 1.81 | 82 | Δ | 100 | Thickened |

*[1]Stability of a blended solution in a projective layer (30° C., 24 hours)

According to the present invention, by using a protective layer of a thermal recording material, composed of a resin emulsion (a) comprising a specific copolymer resin emulsion (b) containing (meth)acrylonitrile and a vinyl monomer copolymerizable therewith and a specific polyolefin copolymer resin emulsion (c), it is possible to sufficiently exhibit durability and running stability under various environments without using a crosslinking agent, thereby simultaneously realizing extremely high productivity and stability (reduction of environmental burdens) of the thermal recording materials.

What is claimed is:

1. A thermal recording material comprising a heat-sensitive recording layer formed on a support and color-developed by heat, and a protective layer formed on the heat-sensitive recording layer and comprising a resin emulsion (a), wherein, (1) the resin emulsion (a) comprises a copolymer resin emulsion (b) containing (meth)acrylonitrile and a vinyl monomer copolymerizable therewith, and having an SP value (solubility parameter) of 12.0 or more, a glass transition temperature (Tg) of 10 to 70° C., and a minimum film-forming temperature (MFT) of 5° C. or less, and a polyolefin copolymer resin emulsion (c) having a particle size of 2000 nm or less, (2) 1 to 10 parts by weight of vinyl monomers having a carboxyl group is comprised in 100 parts by weight of the solid content of the copolymer resin emulsion (b), and (3) the protective layer does not contain a crosslinking agent.

2. The thermal recording material according to claim 1, wherein a solid content weight ratio of the copolymer resin emulsion (b)/the polyolefin copolymer resin emulsion (c) in the resin emulsion (a) is in a range from 100/10 to 100/0.5.

3. The thermal recording material according to claim 2, wherein the polyolefin copolymer resin emulsion (c) is at least one selected from the group consisting of a homopolymer of an α-olefin having 2 to 16 carbon atoms and a copolymer of two or more of the α-olefins.

4. The thermal recording material according to claim 1, wherein the polyolefin copolymer resin emulsion (c) is at least one selected from the group consisting of a homopolymer of an α-olefin having 2 to 16 carbon atoms and a copolymer of two or more of the α-olefins.

* * * * *